US006065685A

United States Patent [19]

Tschumi

[11] Patent Number: 6,065,685

[45] Date of Patent: May 23, 2000

[54] SPRAY NOZZLE

[75] Inventor: Otto Tschumi, Frauenfeld, Switzerland

[73] Assignee: MBT Holding AG, Zurich, Switzerland

[21] Appl. No.: 09/068,593

[22] PCT Filed: Sep. 24, 1997

[86] PCT No.: PCT/EP97/05325

§ 371 Date: Oct. 19, 1998

§ 102(e) Date: Oct. 19, 1998

[87] PCT Pub. No.: WO98/13563

PCT Pub. Date: Apr. 2, 1998

[30] Foreign Application Priority Data

Sep. 24, 1996 [CH] Switzerland ..... 2327/96

[51] Int. Cl.[7] ..... B05B 7/14

[52] U.S. Cl. ..... 239/8; 239/412; 239/434; 239/571

[58] Field of Search ..... 239/398, 407, 239/412, 418, 570, 432, 434, 546, 571, 590, 590.3, 590.5, 1, 10, 504, 8, 9; 277/515, 525, 531; 285/13, 14, 95, 910; 137/526

[56] References Cited

U.S. PATENT DOCUMENTS 2,690,901 10/1954 McCormack .
4,093,124 6/1978 Morane et al. ..... 239/327
4,667,884 5/1987 Braziel ..... 239/590

FOREIGN PATENT DOCUMENTS 2 229 653 A 3/1990 United Kingdom .

OTHER PUBLICATIONS

Database WPI, AN 94–239508, XP002031055 Copy of PCT International Search Report for PCT/EP97/05325 dated Jan. 15, 1998.

*Primary Examiner*—Kevin Weldon
*Assistant Examiner*—Sean P. O'Hanlon
*Attorney, Agent, or Firm*—Fish & Richardson P.C.

[57] ABSTRACT

A spray nozzle of the type adapted to feed a liquid to a material being sprayed therefrom comprises a tubular spray conduit around which is arranged an annular feed port, this feed port being closed in a liquid-tight manner by resilient material openable by liquid pressure and whose degree of opening, and therefore the quantity of liquid fed to the material, rises linearly with increasing liquid pressure. Preferably, the resilient material is provided by a membrane ring (7) which is a flat ring with inwardly-tapering radial ridges (8*b*) raised thereon, the gaps between the ridges being filled with an elastomeric material, such that a series of resilient segments (9) is created. Under liquid pressure, the segments are compressed equally, giving a nearly completely annular flow of liquid into the material. The nozzle is particularly useful for the spraying of concrete, especially by the dry method.

10 Claims, 2 Drawing Sheets

SPRAY NOZZLE

This invention relates to spray nozzles, and more particularly those for use in the spraying of cementitious compositions such as concrete.

Spray nozzles for the purpose of applying cementitious compositions such as shotcrete, usually include a means of injecting a liquid into the composition. In the so-called "dry process" wherein a dry spraying mixture is conveyed to the nozzle, the liquid consists mainly of water, often with admixtures such as accelerators dissolved or dispersed therein. In the "wet process" wherein a wet mixture (with water already added) is conveyed to the nozzle, the liquid is generally a solution or dispersion of admixtures. This liquid injection is generally effected by a liquid supply pipe which injects liquid into the composition via a port in the nozzle. The amount of liquid to be added may be varied by means of a valve in the supply pipe. In such a case, the operation of the valve changes the injection pressure of liquid being supplied which varies the velocity of injection of the liquid while the cross section of the port remains the same, thus changing the depth of penetration of the liquid in the composition stream passing through the nozzle. This disturbs the homogenity of the composition as soon as the injection pressure is no longer high enough to moisten the composition homogeneously.

This problem is well known and a solution thereto has long been sought. One proposed apparatus comprises an annular port, the gap width of which can be changed only when the nozzle is dismantled, i.e. before the initial operation. A change of the gap width therefore involves a long interruption of the operation, so that neither fluctuations in the composition of the concrete, nor fluctuations of the liquid pressure can be balanced as soon as would be desirable.

A further development is represented by a construction with several ports, the outflow cross section of which may be adjusted externally during operation. This construction has its advantages, but also has disadvantages, one of which being the fact that the operator of the unit has to adjust the cross section of the port to provide the amount of liquid desired, which action requires a great deal of concentration during work as well as experience in operating such units. A still further disadvantage is the fact that the ports easily become clogged, thus changing the outflow velocity of the other ports due to the pressure increase, and as a result the whole unit has to be dismantled in order to clean the ports. A further disadvantage of this is that, since this unit only has a few ports of adjustable cross section, the composition flow is not continuously radially moistened and is therefore not homogeneous.

Another known spray nozzle comprises two coaxial tubes, one fixed and the other movable but resiliently urged against the first. The supply of liquid for injection into a sprayable composition forces the movable tube away from the fixed tube, thus defining an annular duct through which the liquid can enter the sprayable composition. As the pressure increases, so does the width of the duct, thus guaranteeing an almost constant outflow velocity. However, such a nozzle is complicated with many components, and it is expensive and too impractical to be generally acceptable. It has now been found that it is possible to make a spray nozzle which is substantially free from the disadvantages of the art. The invention therefore provides a spray nozzle of the type adapted to feed a liquid to a material being sprayed therefrom, which nozzle comprises a tubular spray conduit around the circumference of which, in a plane perpendicular to the direction of flow of the material, is disposed an annular liquid feed port which is fed from a pipe feed via an annular reservoir which surrounds the tubular spray conduit in the vicinity of the feed port, characterised in that the feed port is closed in a liquid-tight manner by resilient material openable by liquid pressure and whose degree of opening, and therefore the quantity of liquid fed to the material, rises proportionally or linearly with increasing liquid pressure.

The resilient material may be an element which may take any of a number of shapes, for example, a torus, and especially a ring with flat upper and lower surfaces.

The nozzle according to this invention has numerous advantages; it consists of relatively few components, it is efficient, and it is rugged and reliable in use.

The spray nozzle according to the invention comprises a spray conduit and means arranged around it to inject liquid through an annular liquid feed port with self-adjusting outflow cross section into the material being sprayed with an injection velocity of the liquid into the material independent of that of the entry velocity of the liquid being supplied to the spray nozzle.

In a preferred embodiment of the invention, the resilient material is present in the form of individual segments which are movable independently of each other and which open uniformly under liquid pressure. More preferably, these segments are so configured that under liquid pressure there is opened an almost uninterrupted annular gap, thus permitting the entrance of an annular liquid stream into the material being sprayed from the nozzle.

In a further preferred embodiment, the nozzle comprises a cylindrical spray conduit with liquid feed provision, the spray conduit being in two sections, there being fitted between these sections and coaxial therewith a membrane ring, the membrane ring consisting of (i) a base member comprising a rigid ring, flat on one side and having an outer and an inner circumference, said flat side abutting against the end of one section, and which comprises on the other side and perpendicular thereto a plurality of identical substantially evenly-spaced, radially-arranged ridges which taper in the direction of the inner circumference, ending in apices which lie on or near that inner circumference; and;

(ii) filling the space between each pair of ridges, a continuous flexible membrane, said membrane being of the same height as the ridges and adapted to abut against the end of the other conduit section; the ridges and the membrane between them thus forming a series of flexible segments, liquid feed to said segments being by means of channels formed within that conduit section which contacts the membrane, and which communicate with said liquid feed provision.

According to the invention, the liquid supplied to the nozzle is directed via the channels to the flexible segments, such that liquid passed therethrough under pressure will compress the membrane, thereby opening a gap between membrane and conduit section and gaining access to the material to be sprayed The flexible membrane fills the space between the ridges and is level with the tops thereof, in effect forming with the ridges a thick composite ring which consists of a series of flexible segments separated by inflexible ridges. By "flexible" is meant having sufficient flexibility to be compressed under the pressure of the liquid delivered to the membrane to a sufficient extent to form a gap and allow the release of liquid. The flexible membrane is therefore of an elastomeric material which should also be durable (that part which conforms to the inner diameter of the ring is in direct contact with the material being sprayed), hydrophobic and chemically resistant. A particularly preferred material is a polyurethane, but given the performance parameters, a skilled person can easily select a suitable material.

An important feature of the ridges of the base member hereinabove mentioned is that they taper as they approach the inner circumference of the ring, ending at apices on or near to that circumference. This has the effect of permitting the achievement of a nearly completely circular spraying pattern, thus ensuring that the material to be sprayed is uniformly moistened. Provided that this tapering is observed, the cross-section shape of the ridges in a plane transverse to the flow of material to be sprayed is not critical. The preferred shape for reasons of ease of manufacture is a narrow isosceles triangle.

The membrane ring may conveniently be prepared by moulding the flexible membrane on to the base member. The ridges will help locate the flexible membrane in place, but they may be assisted by, for example, bores made into the base member in the direction of the abutting section, but not extending through the base member.

The liquid to be supplied to the sprayable material may reach the flexible segments by means of a series of channels, one per segment, which run from an annular reservoir to that face of the spray conduit section which contacts the membrane. The membrane ring and the channels may be so configured that a channel end interfaces with a membrane segment midway between the ridges which define that segment. Thus, under fluid pressure, the individual membrane segments are compressed, thereby permitting a circumferential injection of fluid into the spraying material. As the fluid pressure is increased, the segments are compressed to a larger extent, thus keeping the entry velocity essentially constant.

Provided that the features hereinabove mentioned are present, the actual construction of the nozzle is not critical, and the skilled person will readily see a number of possibilities for construction. For example, the channels may be in one spray conduit section, or, preferably, they may be incorporated in a separate unit which fits between the two sections and which interfaces with the membrane.

In an alternative arrangement, the plurality of feed channels mentioned hereinabove may be replaced by at least one feed channel located within the nozzle section abutting against the membrane, fluid pressure being applied to the entire surface of the membrane by means of an annular channel formed in that end of the nozzle section so as to interface with said membrane and joined to said feed channel. When fluid pressure is applied, the pressure is uniformly applied to the surface of the membrane via the feed channel and the annular channel, and there is achieved an essentially unbroken fluid stream. It is possible and permissible to have a single feed channel, but it has been found that two such channels diametrically opposed gives better pressure equilibration and this is the preferred arrangement.

The injection of fluid into the sprayable material may be in a plane which is perpendicular to the direction of sprayable material flow. It can often be advantageous to inject the fluid at an angle other than perpendicular to the direction of sprayable material flow, such that the fluid feed essentially forms a cone rather than a circle. This cone can be directed in the direction of the sprayable material flow, or against it. This may be achieved by shaping the ridges and the membrane such that, instead of a continuous, flat circular surface, they form a continuous frusto-conical surface the apex of which cone lies on the longitudinal axis of sprayable material flow. The end of the spraying nozzle section which abuts against the membrane is profiled to match this shape.

In accordance with a particularly preferred embodiment, the invention provides a spray nozzle, in particular for the spraying of concrete, having a tubular spray conduit and means arranged therearound for the purpose of injecting a liquid into the mixture, the means forming at least one portion of the tubular spray conduit, characterized in that said means includes a fixed cylindrical sleeve (3, 103) and a membrane ring (7, 107), also fixed and abutting against the cylindrical sleeve (3, 103), said membrane ring having a plurality of resilient segments (9, 109) in part defining the cylindrical inner side of membrane ring (7, 107), said segments being evenly distributed around the circumference and their faces abutting against the cylindrical sleeve (3, 103), such that the cylindrical sleeve (3, 103) and membrane ring (7, 107) form a liquid-tight seal, the cylindrical sleeve (3, 103) comprising on its outer circumference an annular reservoir (4, 104), from which reservoir extends at least one bore (5, 105) parallel to the cylinder axis, which bore provides liquid communication between the annular reservoir and the face in abutment with the membrane ring (7, 107), said resilient segments (9, 109) being formed and arranged in relation to the bores so that they can be compressed uniformly by the pressure of the liquid to be injected, thus forming one gap each between the abutted faces of resilient segments (9, 109) and face (3*b*) of the hollow cylinder (3, 103), the discharge cross section of which increases in size under increasing pressure, thus guaranteeing an at least approximately constant outflow velocity.

While the nozzles of the invention are useful for the spraying of any material where there is a need to inject a liquid into the sprayed material at the nozzle, the nozzles of the invention are particularly useful for the spraying of cementitious compositions, such as shotcrete. Moreover, although they are particularly suitable for the spraying of cementitious compositions by the "dry" method, they are also useful for spraying such compositions by the "wet" method.

The invention therefore further provides a process of spraying a cementitious composition on to a substrate by the dry method, wherein a dry spraying mix is supplied to a spray nozzle in which a liquid is added thereto, sufficient to cause the composition to set, the spray nozzle being as hereinabove described.

The invention also further provides a process of spraying a cementitious composition on to a substrate by the wet method, wherein a wet spraying mix is supplied to a spray nozzle in which a liquid admixture is added thereto, the spray nozzle being as hereinabove described.

All of the parts of the nozzle of the present invention can be conveniently made from known, readily-available materials using art-recognised equipment and techniques. The finished nozzle is convenient and reliable in operation and easy to maintain and service in the field.

The invention is now further described with reference to the drawings. These drawings depict preferred embodiments and do not limit the invention in any way. The particular embodiments depicted hereinunder relate to a nozzle particularly adapted to the spraying of concrete by the dry method.

Figure 1:
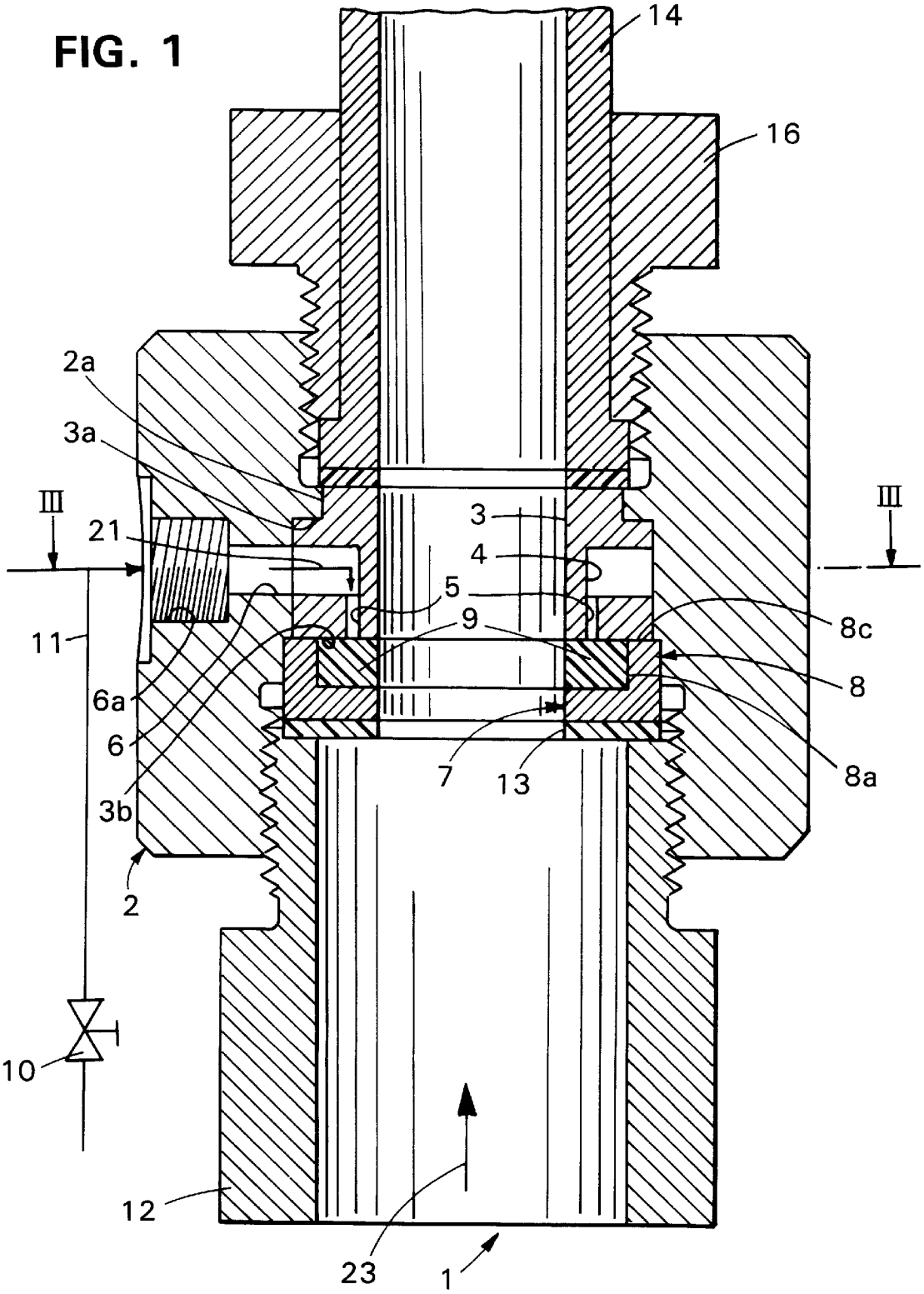
FIG. 1 depicts a longitudinal section through a spray nozzle according to the invention, i.e. a section along line I—I of FIG. 3.
Figure 2:
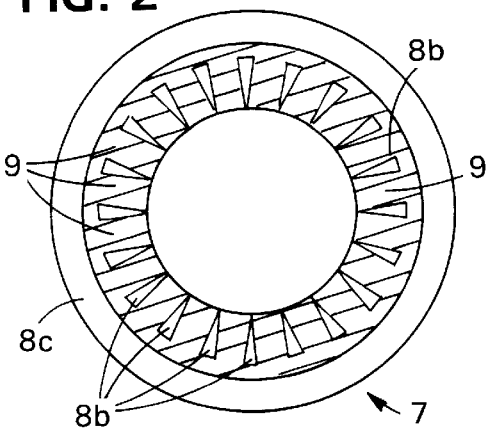
FIG. 2 depicts a horizontal projection of the membrane ring of the spray nozzle shown in FIG. 1.
Figure 3:
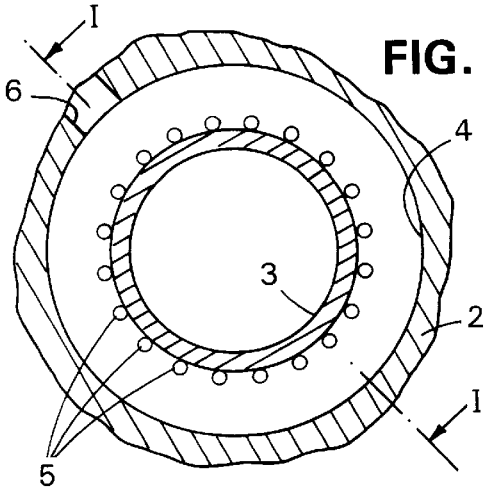
FIG. 3 depicts a section along line III—III of FIG. 1.
Figure 4:
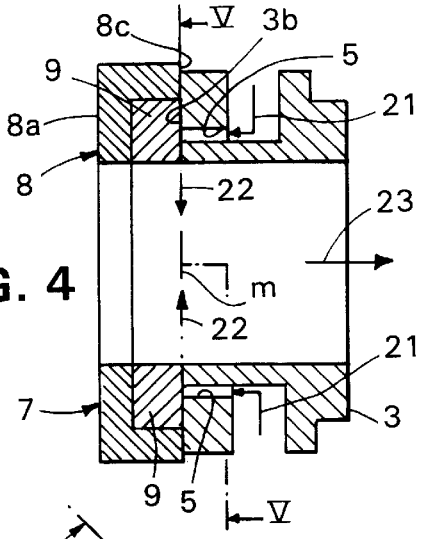
FIG. 4 depicts a longitudinal section through the nozzle head of the unit shown in FIG. 1.

The spray nozzle shown in FIG. 1 and marked with 1 consists of a nozzle section 14, a tubular jacket 2 in which a cylinder sleeve 3 is seated and a supply pipe securing nut 12, the nozzle section 14 being secured to the tubular jacket 2 by a securing nut 16. These components together define a cylindrical passage through which a dry concrete spraying mixture is passed. The cylinder sleeve 3 abuts with its shoulder 3*a* against an annular rib 2*a* projecting inside the inner side of the tubular jacket, and it additionally comprises, extending inwardly from its cylindrical outer side, an annular reservoir 4 from which run radially-arranged identical bores 5, these being evenly-spaced and parallel to the longitudinal axis of the cylindrical passage. These bores are connected to a connecting bore 6 via annular reservoir 4. A membrane ring 7 abuts against the cylinder sleeve 3. This membrane ring comprises a metal carrier 8 which is basically a flat ring having an outer diameter and an inner diameter. Extending perpendicularly from one face of this ring, to the same height, are, on the outer diameter an annular wall 8*c*, and on the flat surface a plurality of identical, evenly-spaced and radially-arranged ridges 8*b*. As can be seen in FIG. 2, these ridges have in plan view the form of narrow isosceles triangles which taper inwardly towards the inner diameter, the apices being on the inner diameter itself. The membrane ring is completed by filling the space between the ridges with an elastomeric polyurethane material so as to define a ring-shaped membrane whose flat upper surface remote from the metal carrier flat surface is flush with the tops of the ridges 8*b* and the annular wall 8*c*, and whose inner diameter corresponds with that of the metal carrier. The ridges 8*b* thus divide the membrane into a series of segments 9 which meet at the apices of the ridges. The polyurethane material is hydrophobic and chemically resistant and is selected according to parameters well known in the art such that it will deflect under liquid pressure to the required degree.

When the nozzle is assembled by screwing together supply pipe nut 12, nozzle section 14, jacket 2 and cylinder sleeve 3, the membrane ring 7 is held in liquid-tight contact between supply pipe nut 12 and both inner sleeve 3 and jacket 2, the membrane abutting directly against the latter two. A seal ring 13 is fitted between nut 12 and membrane ring 7.

The number of bores 5 equals the number of ridges 8*b* (20 each in the present case) and the membrane ring is placed so that each bore impinges on the membrane midway between two ridges.

Pipe 11, equipped with a control valve 10, serves for the purpose of supplying liquid to annular reservoir 4 via connecting bore 6.

If the liquid pressure in reservoir 4 is sufficiently high, the segments 9 are compressed to the same extent because of the uniform liquid pressure being exerted on all segments 9. Between each segment 9 and the face 3*b* of cylinder sleeve 3 a gap is formed, with a gap width which depends on the exerted liquid pressure. From these gaps, a flat, circular liquid stream is discharged, its width depending on the size of segments 9. Because the ridges 8*b* have their apices at the inner diameter of the ring, there is formed an essentially continuous annular gap m with a uniform gap width which gives rise to an annular and homogeneous liquid stream.

Figure 5:
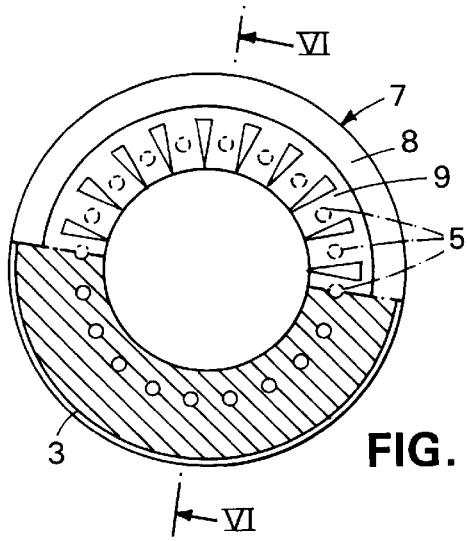
FIG. 5 depicts a section along line V—V of FIG. 4.

FIG. 5 shows that the individual segments 9 of membrane ring 7 each correspond to a bore 5. This construction has the advantage that the liquid stream arriving at annular reservoir 4 is divided into liquid streams perpendicularly directed to segments 9. These liquid streams generate the force necessary to compress segments 9. In doing so, the flow velocity of the liquid being discharged from the annular gap can be optimized, that is, a high injection velocity can be generated, which makes it possible that at least one part of the water stream being discharged from annular gap m penetrates into the centre of the concrete mixture.

In a pressure-free state, the resilient segments 9 and the metal carrier 8 contact the face of cylinder sleeve 3 without forming a gap in a liquid-tight relationship so that the faces of membrane ring 7 and cylinder sleeve 3 facing each other are protected from impurities caused by material possibly present in the mixture passage.

If a liquid pressure acting upon membrane ring 7 is built up via control valve 10, i.e. liquid is conducted into annular reservoir 4, it flows through the bores 5 on to segments 9 in the direction of arrow 21, thus causing these segments to be under constant compression and to form the abovementioned annular gap m from which the liquid is discharged as a homogeneous, annular liquid stream in direction of arrow 22, thus moistening the concrete mixture being conducted in direction of arrow 23—or possibly in the opposite direction—through the cylindrical passage. The width of the annular gap m depends in particular on the amount of liquid being conducted through reservoir 4 per time unit and increases accordingly. Due to the fact that the discharge cross section of the liquid to be injected depending on the gap width increases with rising pressure, an at least approximately constant outflow velocity is generated which is independent from the flow rate. This means that only control valve 10 serves as a means for altering the flow rate during constant outflow velocity.

Should the annular gap m between cylinder sleeve 3 and membrane ring become contaminated or clogged, the connecting nut 12 is removed from jacket 2 so that membrane ring 7 and cylinder sleeve 3 can be removed from the jacket opening and the impurities can be rinsed off easily, or the membrane ring easily replaced.

In the case where the plane of the abovementioned faces of cylinder sleeve 3 and membrane ring 7 is perpendicular to the direction of flow of the material to be sprayed, a flat, annular water stream is generated as hereinabove described. Should the faces have a frusto-conical shape, there is generated a frusto-conical water stream. In this embodiment, the particular liquid stream can be directed upstream or downstream into the sprayable mixture; the choice depends on the particular application.

Figure 6:
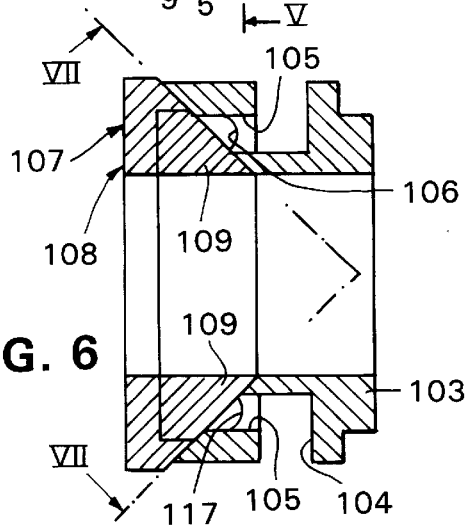
FIG. 6 depicts a longitudinal section through a second embodiment of a nozzle head.
Figure 7:
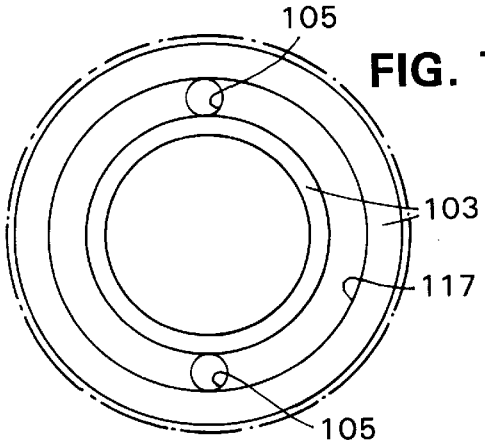
FIG. 7 depicts a section along line VII—VII of FIG. 6.

An arrangement for generating such a water stream can be seen in FIGS. 6 and 7. According to these Figures, this arrangement also consists of a cylinder sleeve 103 with an annular reservoir 104 and a membrane ring 107. The abovementioned principle is also valid for this arrangement and will not be described in detail again, but only with respect to the distinguishing features of the abovementioned arrangement. For the generation of a frusto-conical liquid stream, hollow cylinder 103 and membrane ring 107 (and therefore ridges 109) are provided with matching frusto-conical surfaces.

FIGS. 6 and 7 indicate another possibility for feeding the liquid into the mixture passage. From annular reservoir 104 of cylindrical sleeve 103 run two diametrically-opposed bores 105 which are parallel to the tubular axis. These bores lead into an annular groove 106, 117 of cylinder sleeve 103. This annular groove 106, 117 faces membrane ring 107 and diverts the liquid on to the resilient segments 109 during operation of the unit. Even during feeding of liquid, the same liquid pressure is naturally exerted on all segements 109, so that a homogeneous liquid stream and liquid film, are generated by means of this nozzle head.

It should finally be mentioned that the units and nozzle heads described in FIGS. 1 to 7 only represent a range of various possible embodiments of the invention and can be modified in various respects. The skilled person will readily realise many types of modifications, all of which lie within the boundaries of this invention.

Thus, the number of bores 5 of cylinder sleeve 3 described in FIGS. 1 to 5 and consequently also the number of matching resilient segments 9 can be varied and may, for example, amount to 16, 18, 24 or 32. It is also possible to include an additional seal ring between cylinder sleeve 3 and membrane ring 7.

In addition, there is also the possibility of combining the various shapes and designs of both the nozzle heads described in FIGS. 1 to 7 and, if necessary, modifying the nozzle described in FIGS. 1 to 4 in such a way that it creates a frusto-conical liquid stream during operation, or to use a nozzle head for the purpose of creating an annular liquid stream including an annular groove for feeding the liquid in the way described in FIGS. 6 and 7.

I claim:

1. A spray nozzle adapted to feed a liquid to a material being sprayed therefrom, which spray nozzle comprises a tubular spray conduit around the circumference of which, in a plane perpendicular to the direction of flow of the material, is disposed an annular liquid feed port which is fed from a pipe feed via an annular reservoir which surrounds the tubular spray conduit in the vicinity of the feed port, characterized in that:

the feed port is closed in a liquid-tight manner by resilient material openable by liquid pressure and whose degree of opening rises proportionally or linearly with increasing liquid pressure.

2. A spray nozzle according to claim 1, wherein the resilient material is present in the form of flexible individual segments which are movable independently of each other and which individual segments open uniformly under liquid pressure.

3. A spray nozzle according to claim 2, wherein the individual segments of the resilient material are so configured that under liquid pressure there is opened an almost uninterrupted annular gap.

4. A spray nozzle according to claim 2, wherein the liquid to be supplied to the material to be sprayed from the nozzle reaches the individual segments by means of a series of channels, one said channel per segment, which channels run from the annular reservoir to that face of the spray conduit section which contacts the membrane, each said channel end interfacing with a segment midway between the ridges defining said segment.

5. A spray nozzle according to claim 2, wherein the liquid to be supplied to the material to be sprayed from the nozzle reaches the flexible segments by means of at least one feed channel located within the nozzle section abutting against the membrane, wherein the liquid exerts fluid pressure to the surface of the membrane by means of an annular channel formed in that end of the nozzle section.

6. A spray nozzle according to claim 1, wherein the the resilient material and the end of the spraying nozzle section is shaped such that the spray of liquid impinging upon the sprayable material has a conical shape, the apex of the cone lying on the longitudinal axis of flow of the sprayable material.

7. A spray nozzle according to claim 1, wherein the spray nozzle comprises a cylindrical spray conduit with a liquid feed provision, the spray conduit being in two sections, there being fitted between these two sections and coaxial therewith a membrane ring, the membrane ring which includes:

(i) a base member comprising a rigid ring, flat on one side and having an outer and an inner circumference, said flat side abutting against the end of one section, and which comprises on the other side and perpendicular thereto a plurality of substantially identical, substantially evenly-spaced, radially-arranged ridges which taper in the direction of the inner circumference, ending in apices which lie on or near that inner circumference; and;

(ii) filling the space between each pair of ridges, a continuous flexible membrane, said membrane being of the same height as the ridges and adapted to abut against the end of the other conduit section;

the ridges and the membrane between them thus forming a series of flexible segments, liquid feed to said segments being by means of channels formed within that conduit section which contacts the membrane, and which communicate with said liquid feed provision.

8. A spray nozzle, in particular for the spraying of concrete, having a tubular spray conduit and means arranged therearound for injecting a liquid into the mixture, the means forming at least one portion of the tubular spray conduit, characterized in that;

said means include a fixed cylindrical sleeve (3, 103) and a membrane ring (7, 107), also fixed and abutting against the cylindrical sleeve (3, 103), said membrane ring having a plurality of resilient segments (9, 109) in part defining the cylindrical inner side of membrane ring (7, 107), said segments being evenly distributed around the circumference and having faces abutting against the cylindrical sleeve (3, 103), such that the cylindrical sleeve (3, 103) and membrane ring (7, 107) form a liquid-tight seal, the cylindrical sleeve (3, 103) comprising on its outer circumference an annular reservoir (4, 104), from which reservoir extends at least one bore (5, 105) parallel to the cylinder axis, which bore provides liquid communication between the annular reservoir and the face in abutment with the membrane ring (7,107), said resilient segments (9, 109) being formed and arranged in relation to the bores so that they can be compressed uniformly by the pressure of the liquid to be injected, thus forming one gap each between the abutted faces of resilient segments (9, 109) and face **(3*b*) of the hollow cylinder (3, 103)**, the discharge cross section of which increases in size under increasing pressure, thus guaranteeing an at least approximately constant outflow velocity.

9. A process for spraying concrete onto a substrate comprising the steps of:

supplying a concrete containing mixture to a spray nozzle according to claim 1; and, subsequently spraying the concrete containing mixture from the spray nozzle onto said substrate.

10. A process for spraying concrete onto a substrate comprising the steps of:

supplying a concrete containing mixture to a spray nozzle according to claim 8; and, subsequently spraying the concrete containing mixture from the spray nozzle onto said substrate.

* * * * *